United States Patent [19]

Marburger et al.

[11] 3,986,685

[45] Oct. 19, 1976

[54] FOLDING TAIL FINS

[75] Inventors: Ivan L. Marburger, Upland, Calif.; Donald E. Howlett, Reno, Nev.; Lawrence J. Nagel, La Verne, Calif.

[73] Assignee: The United States of America as represented by the Secretary of the Army, Washington, D.C.

[22] Filed: Dec. 4, 1975

[21] Appl. No.: 637,602

Related U.S. Application Data

[62] Division of Ser. No. 493,005, July 30, 1974, Pat. No. 3,946,969.

[52] U.S. Cl. ..... 244/3.28

[51] Int. Cl.[2] ..... F42B 13/32

[58] Field of Search..... 244/3.27, 3.28, 3.29

[56] References Cited

UNITED STATES PATENTS 3,098,446 7/1963 Jasse ..... 244/3.28

FOREIGN PATENTS OR APPLICATIONS 977,111 12/1964 United Kingdom..... 244/3.28

*Primary Examiner*—Verlin R. Pendegrass

*Attorney, Agent, or Firm*—Nathan Edelberg; Robert P. Gibson; Harold W. Hilton

[57] ABSTRACT

A rocket having flip out tail fins with cooperating surfaces on said fins and the rear of said rocket to maintain said fins in extended position. Spring means for urging said cooperating surfaces into engagement with each other.

2 Claims, 3 Drawing Figures

FOLDING TAIL FINS

This is a division, of application Ser. No. 493,005, filed July 30, 1974, and now U.S. Pat. No. 3,946,969.

BACKGROUND OF THE INVENTION

In a tube launched rocket the tail fin structure must be capable of being folded or retracted to within the missile profile while the missile is within the launch tube. The fins must then be capable of extension into the air stream after launch. Means must be provided to firmly maintain said fins in their extended position.

In accordance with the need it is an object of this invention to provide a flip out fin structure which can be maintained in its extended position.

DETAILED DESCRIPTION OF THE INVENTION

Figure 2:
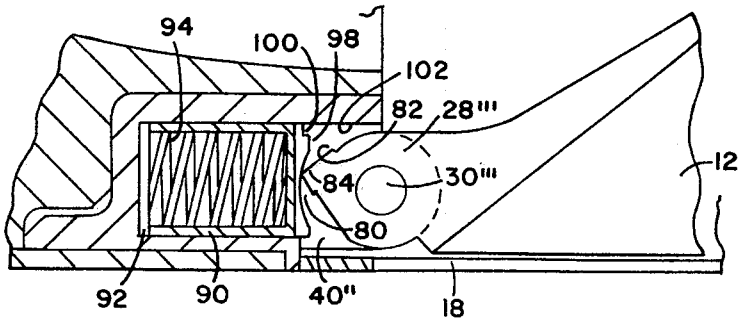
FIG. 2 shows the fin mounting structure of FIG. 1 with the fin shown in retracted position.

Referring now to the drawings and particularly to FIGS. 1 through 3, 10 generally indicates the rear portion of a missile. Four fins, only three of which are shown at 12, 14, and 16, are attached to the rear end of the missile 10. Each of the fins is attached to the missile 10 in the same manner. A shroud 18 is attached to the missile 10 and the fins are adapted to project through slots in the shroud.

Figure 3:
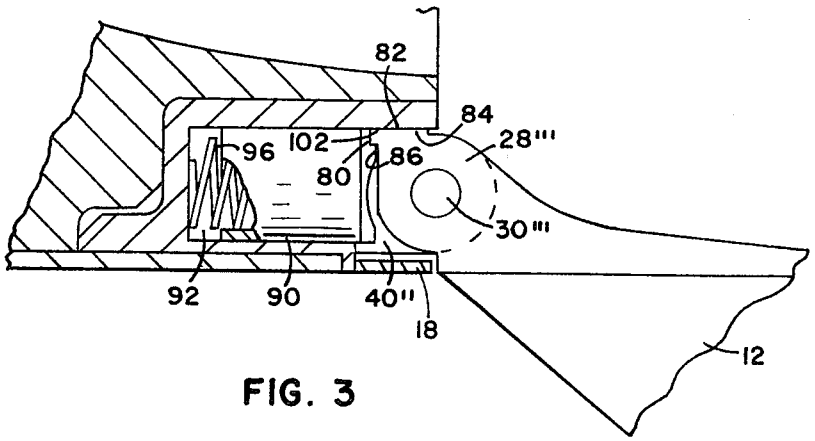
FIG. 3 is the same as FIG. 2 but shows the fin in extended position.
Figure 1:
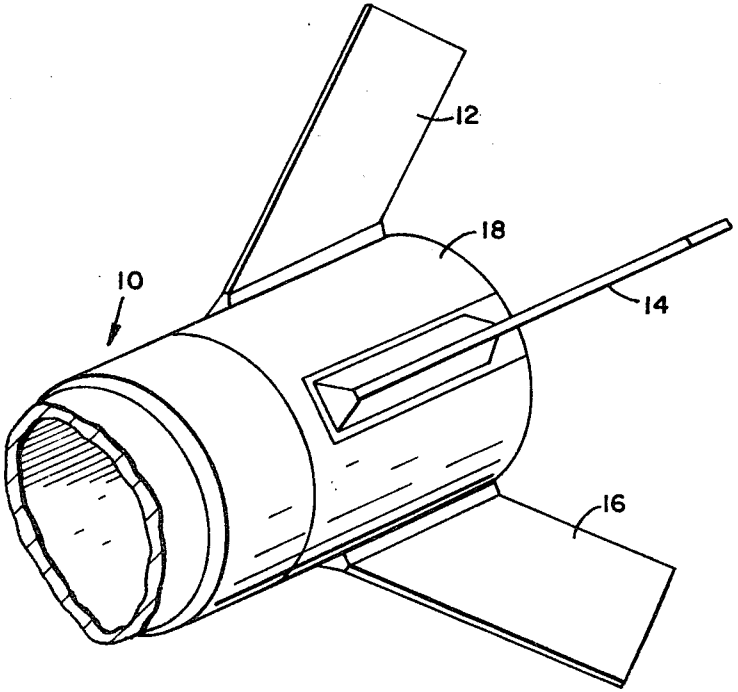
FIG. 1 is a perspective of the rear portion of a missile illustrating the fins of the present invention.

As shown in FIGS. 2 and 3, the fin 12 is provided with a hub 28''' mounted on a hinge pin 30''' between lugs 40''. The hub is provided with two flat surfaces 80 and 82 formed at substantially right angles with each other on a locking lug 84 formed on the hub 28'''. The surface 80 is recessed to provide a lip 86.

A plunger 90 is slideable in a recess 92 formed in the rear of missile 10. A spring 94 normally urges the plunger 90 rearwardly toward the hub 28'''. The rearward end 98 of the plunger 90 is arcuate and the end of the arcuate section is cut off as indicated at 100.

When the fin 12 moves from its retracted position illustrated in FIG. 2 to its extended position illustrated in FIG. 3, the lug 84 rides on the arcuate end portion 98 of plunger 90. When the fin 12 is fully extended the flat surface 82 on the lug 84 abuts a surface 102 on the rear of missile 10 limiting further extension of fin 12. At this point the lip 86 on lug 84 is aligned with the recess 100 on the plunger 90. The spring 94 urges the plunger 90 rearward interengaging the lip 86 and the recess 100 prevent inward movement of the fin 12.

I claim:

1. A flip out tail assembly for a missile comprising:

pairs of lugs mounted on the rear end of said missile and extending rearwardly therefrom;

four fins each having a hinged portion pivotally secured between each said pairs of lugs, and, a locking lug extending outwardly from each said hinged portion;

a plunger slidably mounted in the rear of said missile adjacent each said pair of lugs, said plunger having a rearwardly facing arcuate surface, and, a locking recess disposed on the periphery of said plunger adjacent said arcuate surface;

spring means for moving said locking lug into engagement with said arcuate surface of said plunger, whereby responsive to said fin reaching its fully extended position said locking lug slides off said arcuate surface and into said locking recess to prevent retraction of said fin; and, a shroud assembly fixed to said missile and having four longitudinal slots formed therein through which the fins are adapted to project.

2. A flip out tail assembly as set forth in claim 1 wherein said spring means urges said plungers rearwardly toward their fin lock position.

* * * * *